US005529227A

United States Patent [19]

Yoshikawa et al.

[11] Patent Number: 5,529,227

[45] Date of Patent: Jun. 25, 1996

[54] SLIDING GATE PLATE

[75] Inventors: Toshiyuki Yoshikawa; Etsuhiro Hasebe, both of Kariya; Kenichi Mukoyama, Toyoake; Keizo Hoshi, Anjo; Masahiko Uchita, Kashima-machi; Shouji Ando, Tonosho-machi; Masahiro Ikari, Itako-machi; Teruo Iijima, Kashima-machi, all of Japan

[73] Assignee: Toshiba Ceramics Co., Ltd., Tokyo, Japan

[21] Appl. No.: 287,991

[22] Filed: Aug. 9, 1994

[51] Int. Cl.[6] ..... B22D 41/30

[52] U.S. Cl. ..... 222/590; 222/600

[58] Field of Search ..... 266/236, 45; 264/30; 222/600, 591, 590

[56] References Cited

U.S. PATENT DOCUMENTS

| | | | |
|---|---|---|---|
| 4,445,262 | 5/1984 | Cappelli | 222/600 |
| 4,497,473 | 2/1985 | Robyn et al. | 222/600 |
| 4,801,055 | 1/1989 | Muschner | 222/600 |
| 4,951,929 | 8/1990 | Schwarz et al. | 222/600 |

FOREIGN PATENT DOCUMENTS

| | | |
|---|---|---|
| 51-54108 | 10/1974 | Japan . |
| 59-19789 | 5/1984 | Japan . |
| 60-38660 | 3/1985 | Japan . |
| 61-41456 | 3/1986 | Japan . |
| 63-10063 | 1/1988 | Japan . |
| 64-15270 | 1/1989 | Japan . |
| 1-284473 | 11/1989 | Japan . |
| 2-38159 | 3/1990 | Japan . |
| 5-42349 | 2/1993 | Japan . |

*Primary Examiner*—Scott Kastler
*Attorney, Agent, or Firm*—Pennie & Edmonds

[57] ABSTRACT

According to the present invention, there is provided a sliding gate plate connected to a molten metal container, used as a part of a nozzle, for controlling a flow amount of molten metal in the molten metal container, comprising a main body of the sliding gate plate, having a through-hole at a section corresponding to a molten metal discharge control, and a cylinder having a ring-like fringe portion, and fit into the through-hole of the main body of the plate.

4 Claims, 3 Drawing Sheets

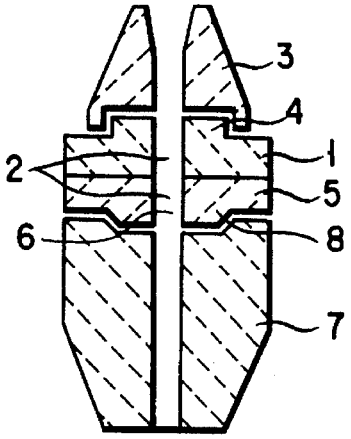
FIG. 3
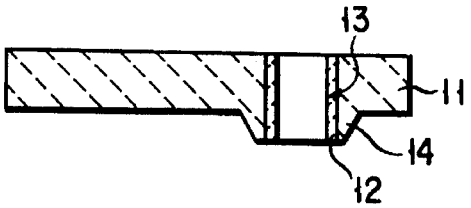
FIG. 4A
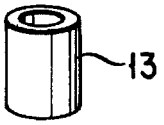
FIG. 4B
FIG. 5
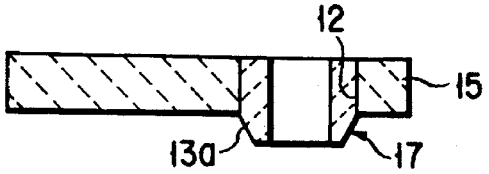
FIG. 6A
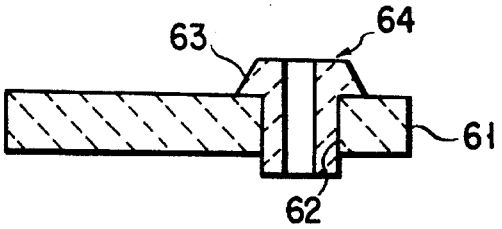
FIG. 6B
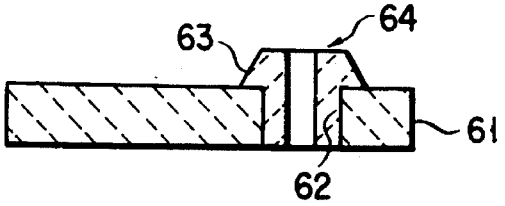

SLIDING GATE PLATE

BACKGROUND OF THE INVENTION

1. Field of the Invention

The present invention relates to a sliding gate plate which is a part of a nozzle used in a flow amount control for molten metal from a molten metal container.

2. Description of the Related Art

As is conventionally known, a nozzle is widely used in a flow amount control for molten metal from a molten metal container. FIG. 3 is a diagram showing an example of the conventional nozzle.

As shown in the figure, a fixing plate 1 has a through-hole 2 for molten metal at a molten metal discharge portion. A projecting portion (connection portion) 4 used for connecting to an upper nozzle 3 is situated at the molten metal discharge portion of the fixing plate 1. A sliding plate 5 which is in slidably contact with the fixing plate 1 is provided such as to be in tight contact with the bottom surface of the fixing plate 1. A through-hole 6 for discharging molten metal is provided at the molten metal discharge portion of the sliding plate 5, and a projecting portion (connection portion) 8 for connecting to a lower nozzle 7 is situated at a molten metal discharge portion.

In the nozzle having the above-described structure, a projecting portion is provided for each of the fixing plate 1 and sliding plate 5 for the purpose of increasing the adhesive property with respect to the upper nozzle (or lower nozzle) and preventing the suction of air from the non-contact portion.

With the conventional sliding gate plate, the through-hole running through the fixing plate 1 and sliding plate 5 is chemically and physically damaged by the molten metal. In order to avoid this, it is proposed that the sliding gate plate should be made to have a structure shown in, for example, FIG. 4A. FIG. 4B is a perspective view of a cylinder which is an insert ring, that is, a part of the plate shown in FIG. 4A. In short, the plate has a structure in which a cylinder 13 is inserted to a through-hole 12 of a projecting portion 14 of a main body of a sliding gate plate 11. The plate shown in FIG. 4 is a sliding gate plate having a structure shown in FIG. 3, and can be obtained by boring the inner wall of the through-hole damaged by molten metal, and inserting the cylinder into the machined through-hole.

Further, FIG. 5 is a diagram showing another type of sliding gate plate, which consists of a sliding gate plate 15 having both surfaces made flat, and a cylinder 13 having a tapered portion 13*a* at its distal end tightly fit into the through-hole 12 of the sliding gate plate 15.

However, both types of the above-described sliding gate plates has a common structure in which a cylinder is fit into the through hole of the main body of the sliding gate plate, which has been subjected to a boring process. Consequently, if the through-hole is excessively processed, it is likely that the cylinder slips loosely out of the through-hole of the main body of the sliding gate plate, disabling the use of the plate.

SUMMARY OF THE INVENTION

The object of the present invention is to provide a sliding gate plate in which the cylinder, by improving its shape, does not slip out of the through-hole of the main body of the sliding gate plate when using, and the cylinder can be easily fit.

According to the present invention, there is provided a sliding gate plate connected to a molten metal container, used for controlling a flow amount of molten metal from the molten metal container, comprising: a main body of the sliding gate plate, having a through-hole at a section corresponding to a molten metal discharge control, and a cylinder having a ring-like fringe portion, and fit into the through-hole of the plate main body.

Further, according to the present invention, there is provided a method of manufacturing a sliding gate plate, comprising the steps of: positioning a main body of a used sliding gate plate having a sliding surface and a projecting surface having a projecting portion, on an opposite side to the sliding surface, the projecting portion having a through-hole whose inner surface is damaged, such that the sliding surface is situated at a position for processing; making a new through-hole whose diameter is increased from that of the damaged through-hole of the main body of the sliding gate plate by processing the damaged through-hole as it is, using a drill or the like; fitting a cylinder having a ring-shaped fringe into the new through-hole of the main body of the sliding gate plate from a sliding surface side; and polishing the projecting portion of the main body after turning over the main body in which the cylinder was fit.

Further, according to the present invention, there is also provided a method of manufacturing a sliding gate plate, comprising the steps of: making a through-hole in a main body of a sliding gate plate having both surfaces made flat; fitting a cylinder having a ring-shaped fringe portion at a top and a length excluding the fringe portion, larger than a thickness of the main body of the plate, from an upper side of the through-hole of the main body of the sliding gate plate, such that the other end of the cylinder projects from the other main surface of the main body; and polishing the other end of the cylinder projecting from the main body of the sliding gate plate such that the other end is shaped the same as the other main surface of the main body of the plate.

In the present invention, the main body of a sliding gate plate of the type in which a projecting portion (dowel) is formed at the molten metal discharge section, or both surfaces are made flat, can be used.

The main body of the sliding gate plate and the cylinder used in the present invention are both made of ceramics. They may be made of the same material or different materials.

Further, it is preferable that the shape of the ring-shaped fringe portion of the cylinder should be made the same as that of the projecting portion required as a sliding gate plate, for example, the shape of the projecting portion of the main body of the sliding gate plate, which is later removed by polishing.

In the present invention, the sliding gate plate is manufactured in the following manner.

First, the main body of a used sliding gate plate is placed such that the sliding surface faces upward and the projecting surface faces downward. Next, the damaged through-hole of the main body of the sliding gate plate is subjected to boring process by using a drill or the like, thereby making a new through-hole. Then, a cylinder having a ring-shaped fringe is fit into the new through-hole of the main body of the sliding gate plate. Lastly, the main body of the sliding gate plate in which the cylinder is fit, is turned over, and the main body of the sliding gate plate is polished, thus obtaining a sliding gate plate having a cylinder fit into its through-hole of the main body.

As described above, according to the present invention, there can be provided, by improving the shape of its cylinder, a sliding gate plate having a high reliability, in which the cylinder does not easily slip out of the through-hole of the main body of the sliding plate while in use, the cylinder can be easily fit into the main body of the sliding gate plate, the tightness of the cylinder with respect to the main body of the sliding gate plate can be improved, and the suction of gas can be suppressed. Further, a used sliding gate plate can be recycled, thereby reducing the production cost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 1A is a plan view, FIG. 1B is a cross section a view taken along the line X—X of FIG. 1A, and 1C is a perspective view of a cylinder;

FIG. 3 is a lateral cross section briefly illustrating a conventional nozzle;

FIGS. 4A and 4B are explanatory diagrams showing a conventional sliding gate plate having a projecting portion at the molten metal discharging portion, FIG. 4A is a front cross section and FIG. 4B is a perspective view of a cylinder;

FIG. 5 is an explanatory diagram showing a front cross section of a conventional sliding gate plate having both main surfaces made flat; and FIGS. 6A to 6B are front cross sectional views showing the steps of the manufacturing method of a sliding gate plate different from that shown in FIG. 2, in order.

DETAILED DESCRIPTION OF THE PREFERRED EMBODIMENTS

(EXAMPLE 1)

Figure 1A:
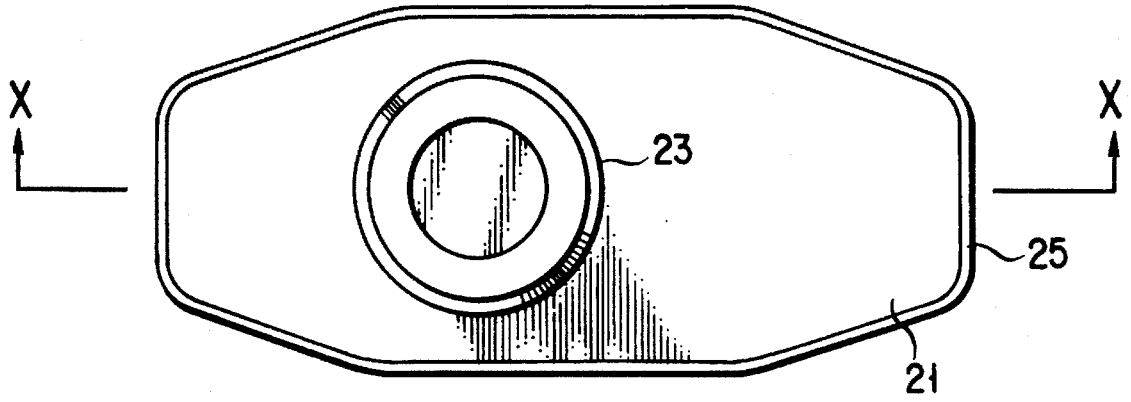
FIGS. 1A, 1B and 1C are explanatory diagrams illustrating a sliding gate plate according to an embodiment of the present invention.
Figure 1B:
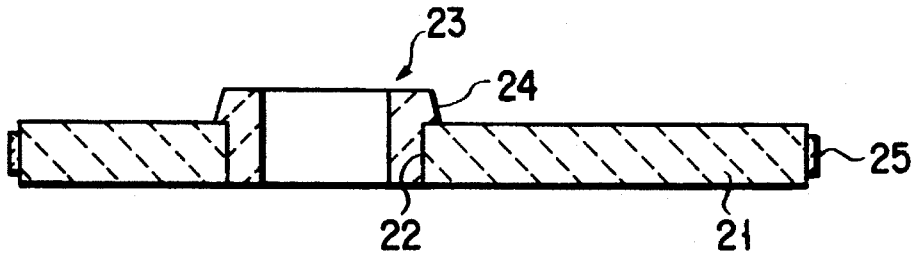
Figure 1C:
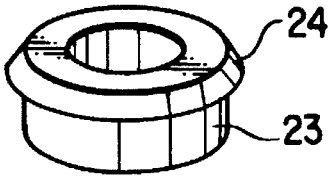

A sliding gate plate (to be called SG plate hereinafter) according to an embodiment of the present invention will now be described with reference to FIGS. 1A to 1C. FIG. 1A is a plan view of the SG plate, FIG. 1B is a cross sectional view taken along the line X—X of FIG. 1A, and FIG. 1C is a perspective view of a cylinder which is a structural element of the SG plate.

The main body of an SG plate 21 has both surfaces made flat, and a through-hole 22 at a section corresponding to the molten metal discharge portion. The material of the main body of the SG plate 21 is ceramics having a fire-proof property and heat-proof property. A cylinder 23 is fit into a through-hole 22 of the main body of the SG plate 21. One end of the cylinder 23 is shaped to be a ring-shaped fringe 24, which engages with the main body of the SG plate 21 when fit the cylinder 23 into the main body. The material of the cylinder 23 is the same as or similar to that of the main body of the SG plate 21. A band-like metal hoop 25 is wound around the peripheral portion of the main body of the SG plate 21.

An example of the method of manufacturing an SG plate having such a structure will be described with reference to FIGS. 2A to 2E.

Figure 2A:
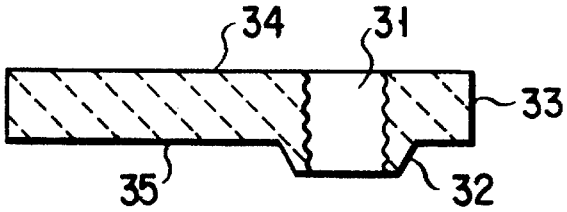
FIGS. 2A, 2B, 2C, 2D and 2E are front cross sectional views illustrating the steps of the manufacturing method of the sliding gate plate, according an embodiment of the present invention, in order.

(1) First, the main body of a used SG plate 33 having a projecting portion 32 and a through-hole 31 whose inner wall surface was damaged by molten metal, is placed such that a sliding surface 34 faced upward and a projecting surface 35 faced downward (FIG. 2A).

Figure 2B:
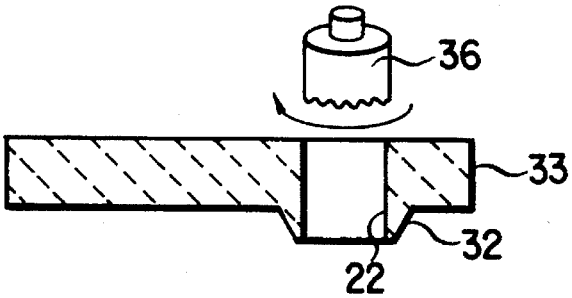

(2) Next, the damaged through-hole 31 of the main body of the SG plate 33 is subjected to a boring process by using a drill 36, thus making a new through-hole 22 (FIG. 2B). It should be noted that the diameter of the new through-hole 22 is larger than that of the damaged through-hole 31.

Figure 2C:
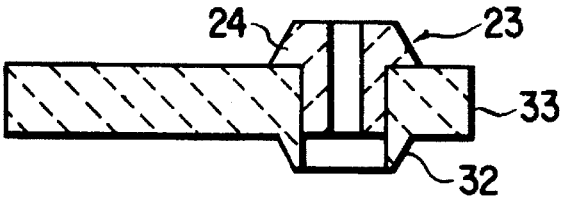

(3) A cylinder 23 having a ring-shaped fringe 24 is fit into the new through-hole 22 of the main body of the SG plate 33 from its upper side. The height of the cylinder 23 excluding the fringe portion 24 is made the same as that of the main body of the SG plate 33 so that one end surface of the cylinder will make the same surface along with the rear surface of the main body of the SG plate 33 when the cylinder 23 is fit into the through-hole 22 (FIG. 2C).

Figure 2D:
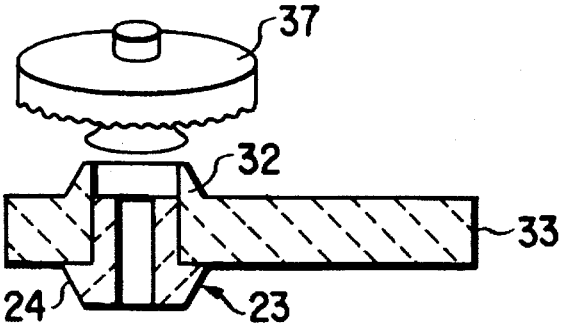

(4) Then, as shown in FIG. 2D, the main body of the SG plate 33 in which the cylinder 23 is fit, is turned over, and a polishing tool 37 is set about the projecting portion 32 of the main body of the SG plate 33.

Figure 2E:
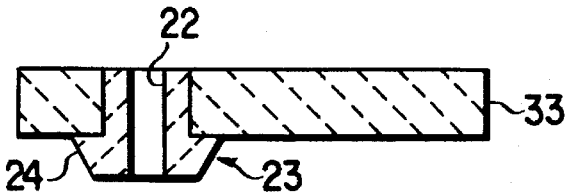

(5) The projecting portion 32 of the main body of the SG plate 33 is polished with the polishing tool 37, thereby obtaining an SG plate 38 in which the cylinder 23 is fit into the through-hole 22 of the main body of the SG plate 33 (FIG. 2E).

The SG plate 38 according to this embodiment consists of the main body of the SG plate 33 having the through-hole 22 at a section corresponding to the molten metal discharge position, and the cylinder 23 having the ring-shaped fringe portion 23 and fit into the through-hole 22 of the main body of the SG plate 33 with this structure, the SG plate 38 exhibits the following effects.

(1) Since the cylinder 23 has the fringe portion 24 which engages with the peripheral portion of the through-hole 22 of the main body of the SG plate 33, the fringe portion 24 stops at the main surface of the main body of the SG plate 33, where one end of the through hole 22 is situated, when the cylinder 23 is inserted all the way through the through-hole 22 of the main body of the SG plate 33. Therefore, even if a somewhat large through-hole 22 is made in the main body of the SG plate, the positioning and the insertion can be carried out in a short period of time without having to consider the positional relationship with regard to the up and down directions when inserting the cylinder 23.

(2) Since the cylinder 23 has the fringe portion 24, it is not necessary to make a hole having the same diameter as that of the projecting portion, in the main body of the SG plate unlike in the conventional technique. In other words, the through-hole 22 of the SG plate can be made small, and the mechanical strength of the SG plate itself can be maintained.

(3) In the case where the SG plate is assembled in an upper nozzle 3 and a lower nozzle 7, both having a recess portion, as shown in FIG. 3, gas (air) has to travel a longer distance than a conventional nozzle to reach the inside when the nozzles are actually used, due to the structure of the recess of each nozzle and the projecting portions 4 and 8 of the SG plate, thus effectively suppressing the suction of gas (air).

(4) In the case where the fringe portion 24 of the cylinder 23 is located on the main body of the SG plate 21, the mechanical strength with respect to the direction of the gravity can be improved by the fringe portion 24, and therefore the cylinder 23 does not slip out of the through hole 22 by the flow of the molten metal.

Further, with the above-described method of manufacturing an SG plate, a used SG plate can be recycled without wasting it. More specifically, in the above manufacturing method, a damaged through-hole 31 of a used SG plate is subjected to a boring process by using a drill 36, and a cylinder 23 having a fringe portion 24 is fit into a new through-hole 22, followed by polishing of the projecting portion 32. Thus, the used SG plate can be recycled, reducing the production cost. At the same time, since the surface which has not been used as a sliding surface of the plate (not damaged surface) can be used as a new sliding surface, a high air tightness and slidability such as of a new product can be achieved.

In the above embodiments, the material of the cylinder is the same as or similar to that of the main body of the SG plate; however the present invention is not limited to these embodiments. More specifically, since molten metal is allowed to flow through the cylinder set in the through-hole of the SG plate, a different material having an improved permeability against the molten metal and an improved corrosion resistance property can be used to prepare the cylinder. In consideration of this, ceramics having a high purity and a high density, which is excellent in terms of the corrosion resisting property, may be used despite the fact that the ceramics does not have very good spalling resistance property.

Further, in an economic sense, the ceramics is a costly material, and therefore it should be used as a composite structure along with a castable refractory (mortar) which is relatively inexpensive, in order to achieve a low cost production as a total.

The above-described embodiments were described in connection with the case where the main body of the SG plate having a projecting portion is used; however the present invention is not limited to these embodiments. For example, a cylinder 64 having a ring-shaped fringe 63 at its top and whose length excluding the fringe portion 63 is larger than the thickness of an SG plate 61 is inserted into a through-hole 62 of the SG plate 61 having both surfaces made flat, such that an end portion of the cylinder 64 projects from the lower surface of the SG plate 61 (FIG. 6A). Then, a part of the cylinder 61 which projects from the lower surface of the SG plate 61 is polished (FIG. 6B).

Further, the embodiments were explained in connection with the case of a double structure type SG plate used for one fixing plate; however the present invention can be applied to a triple structure type SG plate used for two fixing plates, or even to a rotary nozzle.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of manufacturing a sliding gate plate, comprising the steps of:

positioning a main body of a used sliding gate plate having a sliding surface and a projecting surface having a projecting portion, on an opposite side to the sliding surface, said projecting portion having a through-hole whose inner surface is damaged, such that the sliding surface is situated at a position for processing;

making a new through-hole whose diameter is increased from that of said damaged through-hole of said main body of said sliding gate plate by processing said damaged through-hole as it is, using a drill;

fitting a cylinder having a ring-shaped fringe into said new through-hole of said main body of said sliding gate plate from a sliding surface side; and polishing said projecting portion of said main body after turning over said main body in which said cylinder was fit.

2. A method of manufacturing a sliding gate plate, comprising the steps of:

making a through-hole in a main body of a sliding gate plate having both surfaces made flat;

fitting a cylinder having a ring-shaped fringe portion at a top and a length excluding said fringe portion, larger than a thickness of said main body of said plate, from an upper side of said through-hole of said main body of said sliding gate plate, such that the other end of said cylinder projects from the other main surface of said main body; and polishing the other end of said cylinder projecting from said main body of said sliding gate plate such that the other end is shaped the same as the other main surface face of said main body of said plate.

3. The method of claim 1 wherein the projecting portion is polished such that a sliding surface is formed.

4. The method of claim 1 further comprising the step of turning over the main body after fitting the cylinder and before polishing said projecting portion.

* * * * *